US005391316A

United States Patent [19]

Garrett et al.

[11] Patent Number: 5,391,316

[45] Date of Patent: Feb. 21, 1995

[54] LOW-FOAMING, LIQUID CLEANING COMPOSITIONS CONTAINING PARAFFIN AND FATTY ACID SALT

[75] Inventors: Peter R. Garrett, Pantymwyn; Terry Instone, Great Sutton, both of Great Britain; Francesco M. Puerari, Cremona, Italy; David Roscoe, Liverpool; Philip J. Sams, Willaston, both of Great Britain

[73] Assignee: Lever Brothers Company, Division of Conopco, Inc., New York, N.Y.

[21] Appl. No.: 27,970

[22] Filed: Mar. 8, 1993

[30] Foreign Application Priority Data

Mar. 6, 1992 [GB] United Kingdom ..... 9204976
Aug. 11, 1992 [GB] United Kingdom ..... 9217001

[51] Int. Cl.[6] ..... C11D 9/04

[52] U.S. Cl. ..... 252/126; 252/121; 252/550; 252/554; 252/558; 252/162; 252/173; 252/174.17; 252/174.21; 252/548; 252/DIG. 14

[58] Field of Search ..... 252/89.1, 121, 126, 252/127, 550, 554, 558, 162, 170, 171, 172, 173, 174.21, 174.17, 544, 548, DIG. 14

[56] References Cited

U.S. PATENT DOCUMENTS

| | | | |
|---|---|---|---|
| 2,751,358 | 6/1956 | Caviet | 252/153 |
| 2,952,637 | 9/1960 | Bray et al. | 252/127 |
| 3,657,136 | 4/1972 | Lieberman et al. | 252/321 |
| 3,717,590 | 2/1973 | Fetty | 252/127 |
| 3,843,558 | 10/1974 | Farminer et al. | 252/358 |
| 3,931,033 | 1/1976 | Lohr et al. | 252/170 |
| 4,057,505 | 11/1977 | Nakagawa et al. | 252/96 |
| 4,239,641 | 12/1980 | Perner et al. | 252/162 |
| 4,414,128 | 11/1983 | Gaffinet | 252/170 |
| 4,797,231 | 1/1989 | Schumann et al. | 252/171 |
| 5,102,573 | 4/1992 | Han et al. | 252/171 |

FOREIGN PATENT DOCUMENTS

| | | |
|---|---|---|
| 874943 | 7/1971 | Canada . |
| 0080749 | 6/1983 | European Pat. Off. . |
| 0137616 | 4/1985 | European Pat. Off. . |
| 70019974 | 7/1970 | Japan . |
| 1099502 | 1/1968 | United Kingdom . |
| 1407997 | 10/1975 | United Kingdom . |
| 956456 | 10/1982 | U.S.S.R. . |

OTHER PUBLICATIONS

The International Technical Information Institute, Toxic and Hazardous Industrial Chemical Safety Manual, Japan, 1980, p. 358 no month available.

The Merck Index, ninth ed., Merck & Co. Inc., 1976, p. 1171 no month available.

Anderson, L., The Component Fatty Acids of Oils and Fats, 2nd ed., 1952, p. 115 no month available.

Schick, Martin J., ed., Nonionic Surfactants, Marcel Dekker, Inc. NY., 1967, p. 738 no month available.

Chemical Abstracts 99:7217d "Defoamer", vol. 99, No. 2, 1983, p. 79 no month available.

*Primary Examiner*—Paul Lieberman
*Assistant Examiner*—Lorna M. Douyon
*Attorney, Agent, or Firm*—A. Kate Huffman

[57] ABSTRACT

A liquid composition comprising a solubilized hydrophilic oil, a first surfactant which forms a calcium salt which is no more than sparingly soluble in an aqueous solution and a second surfactant which is foaming, different from the first surfactant and in weight excess over the first surfactant is described.

6 Claims, No Drawings

LOW-FOAMING, LIQUID CLEANING COMPOSITIONS CONTAINING PARAFFIN AND FATTY ACID SALT

TECHNICAL FIELD

The present invention relates to surfactant containing, liquid compositions which show a reduced tendency to form a stable foam. Such compositions are of particular utility in the cleaning of hard surfaces such as floors, walls, kitchen or bathroom surfaces and in cleaning soft furnishings such as upholstery, carpets, curtains etc.

While other and broader use of such compositions is not excluded, such as use of the compositions in the manufacture of wood pulp and paper and generally in chemical processing, the compositions will be described with particular reference to hard surface cleaners.

BACKGROUND

The tendency to form a stable foam is a known problem with known hard surface cleaning compositions. While the formation of foam is desirable with many personal washing products, such as shampoos, bath additives and bar soaps, the presence of foam is often undesirable in fabric washing and surface cleaning operations. As a consequence, considerable effort has been directed toward the investigation of antifoaming systems for fabric washing powders (so-called 'Automatic' powders) and in low-foaming carpet and hard surface cleaners.

Antifoaming surfactant compositions are known which comprise mixtures of hydrophobic oils, such as silicone oils, together with particles, such as hydrophobic silica particles or occasionally alumina or titania particles. A large number of patents have been filed in this technical field. In practice antifoaming components are either added to the surfactant compositions during manufacture or shortly before use of said compositions. The step of adding the antifoam component just prior to use is more common with carpet cleaning compositions (which tend to be liquids) than with fabric washing powders. In washing powder technology it is virtually unknown in practice to mix components shortly before use. One reason for the late addition of the antifoam systems to liquid compositions is believed to be the tendency for insoluble particulate matter to settle out of solutions on storage. However, it has also been suggested, in GB 1407997 (P&G), that silicone antifoams are progressively deactivated if allowed to contact surfactants during processing and storage and complex encapsulation routes have been proposed to overcome these difficulties.

The use of hydrocarbons and calcium sensitive, fatty acid soaps as antifoam systems for powder compositions has been disclosed in GB 1099562 (Unilever: 1964). In that citation are disclosed powdered detergent compositions which comprise anionic sulphate or sulphonate detergents, alkaline polyphosphates and a 'suds-depressant' mixture of a hydrocarbon and a fatty acid having from 12 to 31 carbon atoms. The hydrocarbon is broadly defined, as including straight or branched chain alkanes (liquid paraffin oils in 1:1 admixture with high melting paraffin waxes having a boiling point above 90° C.), alkenes, alkylated benzene, condensed aromatics such as naphthalene and anthracene and their alkylated derivatives and alicyclic hydrocarbons, including terpenes and like compounds. Preferred hydrocarbons include those materials having a boiling point above 90° C., such as the aforementioned mixtures of paraffin oils and waxes, dodecyl benzene and turpentine oil.

The use of the combination of solvents, soaps and selected terpene solvents as antifoam systems for liquid hard surface cleaning compositions is further disclosed in EP 0080749 (P&G: 1982). In these compositions, unlike the carpet cleaning compositions mentioned above, it is particularly desirable that the product can be used at will without the step of adding a separate antifoam component. More specifically, EP 0080749 teaches the use of mono (two isoprene units) or sesqui- (three isoprene unit) terpenes in combination with both a specified solvent (2-(2-butoxy-ethoxy) ethanol: available in the marketplace as BUTYL CARBITOL [RTM]) and 0.05–2% wt of one or more of the alkali, ammonium and alkanol-ammonium soaps of C13–C24 fatty acids as an antifoam system. In this citation, these three components are said to interact so as to have an antifoaming activity. The preferred terpenes as disclosed in this citation are the mono and bi-cyclic terpenes of the 'hydrocarbon class' of terpenes such as terpinenes, terpinolenes, limonenes, pinenes and the so-called 'orange' terpenes as obtained from the skins of oranges. Other terpenes including the terpene alcohols, aldehydes and ketones are less preferred.

Terpenes and related compounds suffer from the general disadvantage that they are odiferous compounds and generally lend a pine-like or lemon-like odour to products. It is desirable that the base formulation of cleaning compositions should have a low odour or be odour free. Moreover, it is advantageous for some uses that compositions should also be free of solvents such as butyl carbitol.

SUMMARY OF THE INVENTION

According to the present invention there is provided a liquid composition comprising a solubilised hydrophobic oil and a first surfactant CHARACTERISED IN THAT:

a) the hydrophobic oil is a saturated hydrocarbon with a 50% wt loss boiling point in the range 170°–300° C., b) the first surfactant forms a calcium salt which is no more than sparingly soluble in aqueous solutions of a second foaming surfactant, and, c) the composition comprises, in weight excess over the first surfactant, a second, foaming surfactant which is different from the first surfactant.

DETAILED DESCRIPTION OF THE INVENTION

Without wishing to be bound by any theory of operation, it is believed that the concentrated compositions of the present invention comprise the hydrocarbon oil solubilised in micelles. As the composition is diluted with water of a hardness >1 French at least a part of the saturated hydrocarbon is dissolubilised of solution along with at least a part of the calcium sensitive surfactant.

It is further believed that the synergistic interaction of hydrophobic particles formed on dilution (i.e. the insoluble portion of the calcium salt of the first surfactant) and the hydrocarbon droplets lead to an effective foam control as regards the second surfactant.

Accordingly, a further aspect of the present invention subsists in the use, as an antifoaming additive in a liquid cleaning composition comprising at least one foaming surfactant of a mixture of saturated hydrocarbon with a 50% wt loss boiling point in the range 170°-300° C., and a surfactant other than the first above-mentioned surfactant which forms a calcium salt which is no more than sparingly soluble in aqueous solution.

A particular advantage of such use of a hydrocarbon and a calcium sensitive surfactant, as an antifoam system for addition to or incorporation in a foaming cleaning composition, is that no particles are present in the initial system prior to dilution and consequently settling or other phase separation of these particles does not lead to the separation on storage difficulties mentioned above.

Consequently, compositions according to the present invention are generally isotropic. An advantage of isotropic compositions, in which the hydrocarbon is initially solubilised, is that they need not be shaken or prepared by mixing shortly before use, whereas previous products either needed to be shaken before use, or, where suspensions of relatively large (silicone or fatty) oil droplets were employed, prior products required a high viscosity with the associated disadvantages of opacity and poor dosing/mixing properties. Isotropic compositions are also believed to have an improved temperature stability as compared with non-isotropic compositions.

In the context of the present invention, a surfactant which forms an insoluble or sparingly soluble calcium salt in aqueous solution of foaming surfactants is generally one where the Krafft temperature of the calcium salt is above 45° C. and the solubility product of the calcium salt is generally less than $10^{-8}$ Moles$^3$ Liter$^{-3}$. It is not intended that this limitation should be held to indicate that all surfactants with a solubility product in an aqueous solution of less than $10^{-8}$ Moles$^3$ Liter$^{-3}$ are suitable, but only those surfactants which form a calcium salt which will still precipitate from a solution of foaming surfactant. It is believed that surfactants which form an insoluble or sparingly soluble calcium salt having a solubility product in a aqueous solution of foaming surfactant is greater than $10^{-8}$ Moles$^3$ Liter$^{-3}$ would be unsuitable.

Preferably, compositions according to the present invention are transparent.

Hydrocarbon

As mentioned above, the hydrophobic oil is a saturated hydrocarbon with a 50% wt loss boiling point in the range 70°-300° C.

In the context of the present invention the term 50% loss boiling point is intended to indicate that 50% of the weight of the paraffin can be distilled-off at a temperature within this range under a pressure of one atmosphere.

Preferably the hydrocarbon is a paraffin.

In general, the limits of boiling points of hydrocarbons, preferably paraffins, suitable for use in the composition of the present invention lie between 171° and 250° C.

We have found that the isoparaffins, i.e. branched chain paraffins, are particularly effective.

A further advantage associated with formulations based on the isoparaffins is that the compositions are essentially odour free.

The hydrocarbon content of compositions embodying the present invention is typically in the range 0.2-10wt %, more preferably, 0.5-5% wt, most preferably 0.5-2.0wt %.

Compositions according to the present invention can be free of terpenes and related aromatic compounds.

First Surfactant

As mentioned above, it is essential that the first surfactant forms a calcium salt which is no more than sparingly soluble in aqueous solutions of foaming surfactants.

The insoluble or sparingly soluble calcium salt-forming surfactant content of embodiments of the invention is preferably 0.2-45% wt on product: the upper levels of this range being used for more highly concentrated compositions.

Preferably the insoluble calcium salt-forming surfactant content is in the range 0.2-3.0% wt, most preferably in the range 0.6-2.0% wt.

Surfactants which form insoluble or sparingly soluble calcium salts as hereinbefore defined include carboxylates and their salts, preferably fatty acids, soluble salts of fatty acids (traditional 'soaps') with a suitable cation, preferably derived from fatty acids having an average carbon chain length in the range 8-24.

More preferably, the first surfactant is an alkali metal salt of saturated fatty acids having an average carbon chain length in the range 12-16. The sodium and potassium salts are most preferred.

Alternative calcium-sensitive surfactants include calcium sensitive surfactant phosphates, sulphates and sulphonates. These share the common feature that they are anionic surfactants of which the calcium salt has a Krafft temperature above typical product use temperature.

The use of carboxylates as the first surfactant, preferably fatty acids, and/or phosphates as the first surfactant is particularly preferred, with the fatty acid soaps being the most preferred first surfactant.

The preferred ratio of insoluble calcium salt forming surfactant to the hydrocarbon is in the range 0.4-2:1. The most preferred ratios being in the range 0.9:1-1:0.9.

Second Surfactant

It is essential that the second surfactant, which can be a mixture of surfactant species is a foaming surfactant (or contains at least one foaming surfactant) and is different from the first surfactant.

Typically, the second surfactant is selected from the group comprising, primary and secondary alcohol sulphate, alkyl aryl sulphonates, alkoxylated alcohols, primary and secondary alkane sulphonates, lactobionamides, alkyl polyglucosides, polyhydroxyamides, alkyl glucamides, alkoxylated carboxylates, mono- or dialkyl sulphosuccinates, alkyl carboxylic acid ester sulphonates, alkyl isethionates and derivatives thereof and mixtures thereof.

Preferably the second surfactant comprises one or more of the group comprising: primary alcohol sulphates, alkoxylated alcohols, alkane sulphonates and alkyl aryl sulphonates. More preferably the second surfactant comprises a mixture of primary alcohol sulphates and alkoxylated alcohols. More preferably the primary alcohol sulphates and alkoxylated alcohols are present in a ratio of from 3:1 to 1:1 with a ratio of around 2:1 being particularly preferred.

The preferred primary alcohol sulphate (PAS) comprises a mixture of materials of the general formulation:

$$RO—SO_3X$$

wherein R is a $C_8$ to $C_{18}$ primary alkyl group and X is a solubilising cation. Suitable cations include sodium, magnesium, potassium, ammonium and mixtures thereof.

Particularly preferred PAS molecules are those with a major proportion of $C_{10}$–$C_{14}$ alkyl residues.

These surfactants can be obtained by forming the primary alcohol sulphate from fatty acids obtained from renewable resources such as coconut oil although they can also be obtained from synthetic alcohol sources. These surfactants show very acceptable biodegradation behaviour.

The preferred alkoxyalated alcohols are selected from the group comprising ethoxylated alcohols of the general formula:

$$R_1—(OCH_2CH_2)_m—OH$$

wherein $R_1$ is straight or branched, $C_8$ to $C_{18}$ alkyl and the average degree of ethoxylation m is 1–14, preferably 3–8.

The starting materials for the synthesis of these ethoxylated alcohols are available from both natural and synthetic sources.

Solvents

Compositions according to the present invention can further comprise a solvent, preferably, when present, at level of 5–15% wt on product.

It is believed that the presence of the solvent assists in the solubilisation of the hydrocarbon into micelies. However, as will be shown hereinafter by way of example, the presence of solvents is not a necessary feature of the compositions according to the present invention.

Preferably, any solvent present is selected from: propylene glycol mono n-butyl ether, dipropylene glycol mono n-butyl ether, propylene glycol mono t-butyl ether, dipropylene glycol mono t-butyl ether, diethylene glycol hexyl ether, ethyl acetate, methanol, ethanol, isopropyl alcohol, ethylene glycol monobutyl ether, di-ethylene glycol monobutyl ether and mixtures thereof.

Most, preferably the solvent is a glycol ether or $C_2$–$C_5$ alcohol solvent.

Particularly preferred solvents are selected from the group comprising ethanol (preferably as industrial methylated spirits), propylene glycol mono n-butyl ether (available as 'Dowanol PnB' [RTM]) and di-ethylene glycol monobutyl ether (available in the marketplace both as 'Butyl Digol' [RTM] or 'Butyl Carbitol' [RTM]).

Minors

The compositions of the invention can further comprise other components selected from the group comprising: perfumes, colours and dyes, hygiene agents, viscosity modifying agents, antioxidants, buffers and mixtures thereof. These minor components are not essential for the performance of the invention but the presence of one or more of these components is preferred in practical embodiments of the invention.

It is preferable, where primary alcohol sulphate is present as surfactant that compositions according to the invention comprise a potassium salt as a minor ingredient. It is believed that the presence of such salts improves the low temperature stability of the products.

Particularly preferred compositions according to the present invention comprise:

a) 15–30% wt primary alcohol sulphate (i) and 5–15% nonionic surfactant (ii) wherein the ratio of (i):(ii) falls in the range 3:1 to 1:1,
b) 1–5% wt potassium carbonate,
c) 5–15% wt glycol ether or $C_2$–$C_5$ alcohol solvent,
d) 0.2–5% wt of a paraffin with a 50% wt loss boiling point in the range 170–300 Celsius, and,
e) 0.2–5% wt of a salt of saturated fatty acids having an average carbon chain length in the range 12–16.

EXAMPLES

In order that the present invention may be further understood it will be illustrated hereafter by way of non-limiting examples.

EXAMPLES 1–14

In the following examples the effectiveness of an antifoaming composition was evaluated against comparative examples both by a 'cylinder shaking' test method and a 'bowl-filling' test method.

In the 'cylinder-shaking' test method, 1.5 ml of product was introduced into 50 mls of water in a 100 ml stoppered measuring cylinder and shaken vigorously 40 times by hand. In order to maintain the vigour of the action, the hand was changed after 20 shakes. Each shake involved a vertical up/down motion of 30 cm and, on average, twenty shakes occurred every 5 seconds. After shaking the stoppers were removed and the initial foam height was measured. The maximum foam volume could be calculated from this. The 'decay time', i.e. the time taken for the foam to collapse to a level at which less than 5 ml remained was also determined and recorded. The source of water used was varied and is noted below.

The 'bowl-filling' test method approximates the process of filling a bucket for floor cleaning. 5 liters of water was fed into a 10 liter bowl containing 30 mls of product from a 60° semi-angle funnel through a 20 cm by 13 mm diameter pipe with its end 30 cm above the floor of the bowl. Local well water (12–15 French) was used. Foam collapse as 'half-life' was measured by the time taken for the foam volume to fall such that 50% by area of the air water interface was clear of foam.

The bowl filling test is considered to be a more accurate test of the performance of the products in actual use than the cylinder shaking test.

As a comparative example, paired comparison examples were repeated with a control formulation and a commercially available floor cleaning composition (AJAX CITRON VERT) [RTM], which is believed to employ a terpene-perfume/soap based antifoam system stabilised as a microemulsion in the concentrated (neat) product. In addition comparative examples were performed with terpenes and similar perfume components replacing the hydrocarbon.

The BASE formulation as used in the following examples employed linear alkylbenzene sulphonate (sodium salt of DOBS [RTM] 102) and alcohol ethoxylate (IMBENTIN [RTM] 91-35 OFA) as a surfactant system. The base formulation was as follows:

TABLE 1

| | |
|---|---|
| C10–Cl2 LABS | 4.6% wt |
| C9–C11 Alcohol 5EO | 3.5% wt |
| Butyl Digol | 5.0% wt |
| Sodium Carbonate | 0.5% wt |
| Perfume | 0.6% wt |
| Formaldehyde | 0.03% wt |

TABLE 1-continued

| | |
|---|---|
| Distilled water | to 100% |

It will be noted that the BASE composition is free of both hydrophobic hydrocarbon oil and the calcium sensitive surfactant.

For the CONTROL used in the experiments, 0.4% Coconut Soap (Sodium Salt) was added to the BASE formulation. Coconut soap is a calcium sensitive surfactant.

In the SOLVENT BASE formulation mentioned below the formulation of the composition was as given above for the BASE, except that 1.0% ISOPAR-L (RTM, ex Exxon), commercially available, odour free, branched hydrocarbon with a boiling point range of 171°-191° C. was added to the BASE formulation. This was solubilised by the surfactant present to form a clear solution.

Various levels of Coconut soap were added to the SOLVENT BASE as detailed in the tables below, in order that the synergistic effects of the calcium sensitive soap and the hydrophobic oil could be demonstrated.

The formulation of EXAMPLE 2 comprised 0.5% ISOPAR-L added to the CONTROL formulation (i.e. 0.5% oil plus 0.4% soap).

In EXAMPLE 3 mentioned below, the formulation of the composition was as given above for the CONTROL, except that 1% ISOPAR-M (RTM, ex Exxon), a branched hydrocarbon with a boiling point range of 207°-256° C. was added to the CONTROL formulation (i.e. 1% oil plus 0.4% wt soap).

In EXAMPLE 4, 0.25% ISOPAR-M was added to the CONTROL formulation (i.e. 0.25% oil plus 0.4% soap).

In EXAMPLE 5, 1.0% n-decane (boiling point 174° C.) was added to the CONTROL formulation (i.e. 1.0% oil plus 0.4% soap).

In EXAMPLE 6, 1.0% n-tetradecane (boiling point 254° C.) was added to the CONTROL formulation (i.e. 1.0% oil plus 0.4% soap).

In EXAMPLE 7, 1.0% of ISOPAR-G (RTM ex. Exxon), a branched hydrocarbon with a boiling point range of 155°-175° C. was employed.

In EXAMPLES 8-14, 1.0% of one of the following odiferous essential oils and similar compounds, each commonly used as a perfume or perfume ingredient in cleaning compositions was substituted for the hydrocarbon:

TABLE 2

| EXAMPLE | INGREDIENT | TYPE |
|---|---|---|
| 8 | Limonene | Monoterpene |
| 9 | Linalool | Terpenoid |
| 10 | Citronellal | Terpenoid |
| 11 | Cyclohexanol | Cycloalkanol |
| 12 | Benzyl alcohol | Aromatic alcohol |
| 13 | Menthol | Terpenoid |
| 14 | Glycerol triacetate | Triglyceride |

The following averaged or ranged results were obtained with the controls and formulations given below in repeated experiments taking the average of 4-5 duplicates in each instance:

TABLE 3

| CYLINDER-SHAKING | MAX. VOLUME | DECAY TIME |
|---|---|---|
| 25 French Water at 21° C. | | |
| CONTROL (soap, no solvent) | 45 | 3 min 33 sec |
| 'AJAX' | 24 | 0 min 31 sec |
| SOLVENT BASE + 0.4% SOAP | 32 | 0 min 21 sec |
| Demineralised water | | |
| CONTROL (soap, no solvent) | — | >20 min (stable) |
| 'AJAX' | — | >20 min (stable) |
| SOLVENT BASE + 0.4% SOAP | — | 3-4 min |

From the results given in Table 3 it can be seen that the embodiments of the present invention show an improvement over controls with hard water and a very significant improvement with 'very soft' water.

In particular, the hydrocarbon-based systems of the present invention show a significant improvement over the terpene-based systems of the prior art under the worst possible, (i.e. using de-ionised water) circumstances.

TABLE 4

| BOWL FILLING | Foam 'half-life' |
|---|---|
| BASE (no HC, no soap) | >300 sec |
| CONTROL (soap, no HC) | >300 sec |
| 'AJAX' (terpene, soap) | 102-201 sec |
| SOLVENT BASE (HC, no soap) | >300 sec |
| SOLVENT BASE + 0.1% soap | >300 sec |
| SOLVENT BASE + 0.2% soap | >300 sec |
| SOLVENT BASE + 0.4% soap | 32-108 sec |
| SOLVENT BASE + 0.6% soap | 19-34 sec |
| SOLVENT BASE + 0.8% soap | 27-37 sec |
| SOLVENT BASE + 1.0% soap | 51-55 sec |
| EXAMPLE 2 (half solvent level) | c. 60 sec |
| EXAMPLE 3 (Isopar M) | 26-34 sec |
| EXAMPLE 4 (Isopar M) | 120-180 sec |
| EXAMPLE 5 (n-decane) | 60-120 sec |
| EXAMPLE 6 (n-tetradecane) | 60-120 sec |
| EXAMPLE 7 (isododecane) | >300 sec |
| EXAMPLE 8 (Limonene) | >200 sec |
| EXAMPLE 9 (Linalool) | >200 sec |
| EXAMPLE 10 (Citronellal) | >200 sec |
| EXAMPLE 11 (Cyclohexanol) | >200 sec |
| EXAMPLE 12 (Benzyl alcohol) | >200 sec |
| EXAMPLE 13 (Menthol) | >200 sec |
| EXAMPLE 14 (Glycerol Triacetate) | >200 sec |

From the results given in Table 4 can be seen that under these harsher test conditions that significant effects were obtained with additions of upwards of 0.4% soap to the control formulation. In the presence of neither solvent or soap, in the presence of solvent without soap or in the presence of soap without solvent, foam control was inadequate.

In the presence of around 0.5-1.0% wt soap, with 1 wt % hydrocarbon in formulations according to the present invention, product performance in 12-15 French water was comparable with the commercial product based on terpenes. From Table 4 it can also be seen that where other hydrocarbons were used (see comparative EXAMPLE 7) or terpene or related compounds were used (comparative EXAMPLES 8-14) product performance was poor as compared with embodiments of the present invention (EXAMPLE 2-6 and examples with SOLVENT BASE plus 0.4-1.0% wt soap). Limonene, while showing acceptable behaviour in cylinder-shaking tests, showed poor behaviour in the bowl filling test (EXAMPLE 8).

EXAMPLE 15

The following formulation was prepared by mixing of the components as listed in Table 5. The components are identified as follows:

Sodium PAS: LIAL-123S (RTM ex. Enichem), a sodium salt of primary alcohol sulphate having an average alkyl chain length in the range $C_{12}$–$C_{13}$;

Nonionic: BIODAC L5-S52 (RTM: ex DAC), alcohol ethoxylate;

Solvent: Butyl Carbitol (RTM: ex Union Carbide);

TABLE 5

| COMPONENT | EXAMPLE |
|---|---|
| Sodium PAS | 18.5% wt |
| Nonionic | 9.5% wt |
| Coconut fatty acid | 1.4% wt |
| Solvent | 8.0% wt |
| Perfume | 1.5% wt |
| Isoparaffin | 1.5% wt |
| Potassium Carbonate | 3.0% wt |
| Sodium Hydroxide | to pH 11 |
| Distilled water | to 100% wt |

The product showed excellent cleaning performance and low foaming. In addition when the formulation of EXAMPLE 15 was cooled to 0° C. and stored for 24 hours at that temperature, before re-heating to room temperature, the composition formed a semi-liquid slurry when cold, but when re-heated to room temperature the slurry became liquid without any phase separation. Even after multiple freeze/thaw cycles or prolonged storage at −15° C. there was no irreversible phase separation.

EXAMPLES 16–23

The formulations of Examples 16–23, as given in Table 6, illustrate the behaviour of the antifoaming compositions according to the present invention in the absence of the solvents/hydrotroping agents mentioned in EP 0080749. Components are identified as follows:

SAS: SAS-30 [RTM]; secondary alkyl sulphonate, anionic surfactant ex. Hoechst.

AEO: IMBENTIN 91-35 [RTM]; alcohol ethoxylate, nonionic surfactant.

Soap: Coconut soap, sodium salt of coco fatty acids.

Compositions were prepared by simple mixing of the components. All were clear, isotropic liquids.

Results are given for foam collapse time in a bowl filling experiment as described above.

TABLE 6

| COMPONENT | EXAMPLE | | | | | | | |
|---|---|---|---|---|---|---|---|---|
| | 16 | 17 | 18 | 19 | 20 | 21 | 22 | 23 |
| SAS | 4 | 4 | 4 | 4 | — | — | — | — |
| AEO | 8 | 8 | 8 | 8 | 16 | 16 | 16 | 16 |
| Soap | 1 | 1 | — | — | 1.2 | — | 1.2 | — |
| Isopar-L | 1 | — | 1 | — | 2 | 2 | — | — |
| Collapse time (sec) | 20 | 150 | >300 | >300 | 5 | >300 | 120 | >300 |

Examples 16–19 employ a SAS/Alcohol ethoxylate surfactant system whereas examples 20–21 employ a main surfactant system consisting solely of alcohol ethoxylate.

From Table 6 it can be seen that compositions which comprise both the paraffin hydrocarbon and the fatty acid soap (Examples 16 and 20) show a very acceptable foam collapse time in the absence of the solvent component, whereas the omission of either the hydrocarbon (Examples 17 and 22) or the soap (Examples 18 and 21), or both soap and hydrocarbon (Examples 19 and 23) resulted in an unacceptably long foam collapse time. All percentages are by weight.

We claim:

1. A liquid, aqueous composition for use in neat or dilute form for cleaning hard surfaces which consisting essentially of:
   a. 0.2–5.0% wt of a saturated alkane hydrocarbon with a 50% wt loss boiling point in the range 170°–300° C.;
   b. 0.2–3.0% wt of a first surfactant which is an alkali metal salt of a saturated fatty acid or a fatty acid having an average carbon chain length in the range 12–16, the alkali metal salt forming a calcium salt which is no more than sparingly soluble in an aqueous solution of a second foaming surfactant;
   c. a second foaming surfactant present in the composition in weight excess over the first surfactant and which is different from the first surfactant, said second surfactant being selected from a group consisting essentially of primary and secondary alcohol sulfates, alkyl aryl sulfonates, alkoxylated alcohols, primary and secondary alkane sulfonates, lacto-bionamides, alkyl polyglucosides, polyhydroxyamides, alkyl glucamides, alkoxylated carboxylates, mono- or dialkyl sulfosuccinates, alkyl carboxylic acid ester sulfonates, alkyl isethionates and derivatives thereof and mixtures thereof wherein a ratio of the first surfactant to the hydrocarbon in the composition is in a range of 0.4 to 2:1;
   d. 5–15% wt of a solvent selected from the group consisting of glycol ethers, ethyl acetate, alcohols and mixtures thereof;
   e. optionally 1–5% wt of a potassium salt, all percentages by weight being based on the total weight of the composition.

2. Composition according to claim 1 wherein the second surfactant comprises a primary alcohol sulphate.

3. Composition according to claim 1 wherein the second surfactant comprises a mixture of primary alcohol sulphates and alkoxylated alcohols in a ratio of from 3:1 to 1:1.

4. Composition according to claim 1 wherein the solvent is selected from the group comprising propylene glycol mono n-butyl ether, dipropylene glycol mono n-butyl ether, propylene glycol mono t-butyl ether, dipropylene glycol mono t-butyl ether, diethylene glycol hexyl ether, ethyl acetate, methanol, ethanol, isopropyl alcohol, ethylene glycol monobutyl ether, di-ethylene glycol monobutyl ether and mixtures thereof.

5. Composition according to claim 4 wherein the solvent is a glycol ether or $C_2$–$C_5$ alcohol solvent.

6. Composition according to claim 1 consisting essentially of:
   a) 15–30% wt primary alcohol sulphate (i) and 5–15% nonionic surfactant (ii) wherein the ratio of (i):(ii) falls in the range 3:1 to 1:1,
   b) 1–5% wt potassium carbonate,
   c) 5–15% wt glycol ether or $C_2$–$C_5$ alcohol solvent,
   d) 0.2–5% wt of a paraffin with a 50% wt loss boiling point in the range 170°–300° C., and,
   e) 0.2–5% wt of a salt of saturated fatty acids having an average carbon chain length in the range 12–16.

* * * * *